United States Patent [19]

Panning

[11] Patent Number: 4,603,816

[45] Date of Patent: Aug. 5, 1986

[54] ROTARY SHREDDER

[75] Inventor: Martin H. Panning, Thiensville, Wis.

[73] Assignee: Blower Application Company, Germantown, Wis.

[21] Appl. No.: 432,183

[22] Filed: Oct. 1, 1982

[51] Int. Cl.[4] ..... B02C 1/00

[52] U.S. Cl. ..... 241/266; 241/267; 241/294

[58] Field of Search ..... 241/236, 204, 205, 206, 241/235, 293, 294, 295, 94, 148, 164, 266, 267

[56] References Cited

U.S. PATENT DOCUMENTS

| | | | |
|---|---|---|---|
| 1,776,318 | 9/1930 | Keet | 241/205 X |
| 2,043,328 | 6/1936 | Mosshart | 241/236 X |
| 2,894,697 | 7/1959 | Panning et al. . | |
| 3,502,276 | 3/1970 | Panning et al. . | |
| 3,608,837 | 9/1971 | Panning . | |
| 3,838,826 | 10/1974 | Wallace et al. | 241/294 X |
| 4,241,882 | 12/1980 | Baikoee | 241/236 |
| 4,385,732 | 5/1983 | Williams | 241/236 |
| 4,418,872 | 12/1983 | Nelson | 241/266 X |

OTHER PUBLICATIONS

"Industrial Shredders", Mitts & Merrill, 5-3-82.

*Primary Examiner*—Mark Rosenbaum

*Attorney, Agent, or Firm*—Andrus, Sceales, Starke & Sawall

[57] ABSTRACT

An apparatus for shredding waste material includes first and second cooperating shredding rotors rotatably mounted adjacent to one another in a shredding chamber. Each rotor includes a series of axially spaced toothed ripper blades removably mounted on a shaft and positioned so that the blades of one rotor interleave with the blades of the other rotor. The blades are arranged in a stacked assembly which may be removed as a unit for repair or replacement without removing the rotor shaft. A crank drive arrangement develops relative rotational oscillatory bi-directional motion between the rotors to shred material fed therebetween. The rotors are oscillated out of phase with one another so that their teeth are continuously moving at different relative angular velocities with respect to one another.

12 Claims, 6 Drawing Figures

ROTARY SHREDDER

BACKGROUND OF THE INVENTION

The present invention relates to an apparatus for shredding waste material, and more particularly to such an apparatus having rotary oscillating shredding members.

Various apparatus for shredding waste material are known in the art. See for example U.S. Pat. Nos. 3,608,837, 3,502,276 and 2,894,697. In the above noted apparatus, the shredding members are continuously rotated at different speeds in opposite directions. Although entirely adequate for shredding most waste material, these apparatus are not readily adaptable for shredding flexible elongate material such as string or rope, casette tapes, video tapes or other magnetic recording type tape. Such waste material fed into these types of apparatus merely becomes wound about the shafts, blades and teeth of the individual shredding members until eventually the machine must be shut down to remove the entangled material.

Prior art shredding machines have also had problems with waste material sticking to the tips of the teeth of the shredding blades. These machines thus generally included some type of cleaning fingers positioned closely adjacent the teeth so that material is stripped from the teeth as the teeth pass the stationary fingers. In addition, prior art shredders do not provide any structure for conveniently and easily removing the blades of the shredding members for repair or replacement.

It is thus desirable to provide an improved apparatus for shredding not only conventional waste material such as glass, plastic, steel, or aluminum containers and paper products, but also one that will shred unconventional material such as rope and magnetic tape. It is also desirable to provide an apparatus which provides a convenient method of removing the shredder blades, and one that is self-cleaning to avoid the expense of replacing and/or repairing the cleaning fingers found on most presently available shredding machines.

SUMMARY OF THE INVENTION

An apparatus for shredding waste material includes first and second cooperating shredding rotors rotatably mounted adjacent one another in a shredding chamber, and drive means in driving engagement with the rotors for developing relative rotational oscillatory bi-directional motion between the rotors to shred waste material fed therebetween. Each rotor includes a series of axially spaced ripper blades positioned so that the blades of one rotor interleave with the blades of the other rotor.

In one aspect of the invention, the shredding rotors are oscillated out of phase with one another so that the teeth of the rotors are moving at different relative angular velocities with respect to one another. This difference in relative velocities of the rotors provides a stripping or self-cleaning action to the blades for automatically cleaning debris from their teeth, and also provides the necessary tearing or shearing action to shred material passing therebetween. The teeth of the shredding rotors, which are angled or pitched toward the outlet end of the shredding chamber, draw or feed waste material between the shredding rotors, shred and tear the material during passage therebetween, and force the shredded material toward the outlet and compact it into a container located below the rotors for disposal.

The amplitude, period, phase relationship and angular velocity of the rotors may be varied to provide the most beneficial shredding operation depending upon the types of waste materials being shredded.

In another aspect of the invention, the blades of the rotors are arranged in a stacked assembly which may be removed as a unit without removing the rotor shaft. This arrangement permits easy and convenient repair and replacement of the blades.

In still another aspect of the invention, a third shredding rotor may be positioned between and below the first and second rotors. In this arrangement, the blades of the first and second rotors are not interleaved with each other, but instead are interleaved only with the blades of the third rotor. The third rotor thus alternately works against the first and second rotors and shreds material in two directions of discharge. The first and second rotors act as feeders and also perform some precrushing operations on the material between them.

The shredder of the present invention thus provides an apparatus that is simple in design, self-cleaning, and efficient for shredding multiple types of waste material.

BRIEF DESCRIPTION OF THE DRAWINGS

The drawings illustrate the best mode presently contemplated of carrying out the invention.

In the drawings.

DESCRIPTION OF THE PREFERRED EMBODIMENTS

Figure 1:
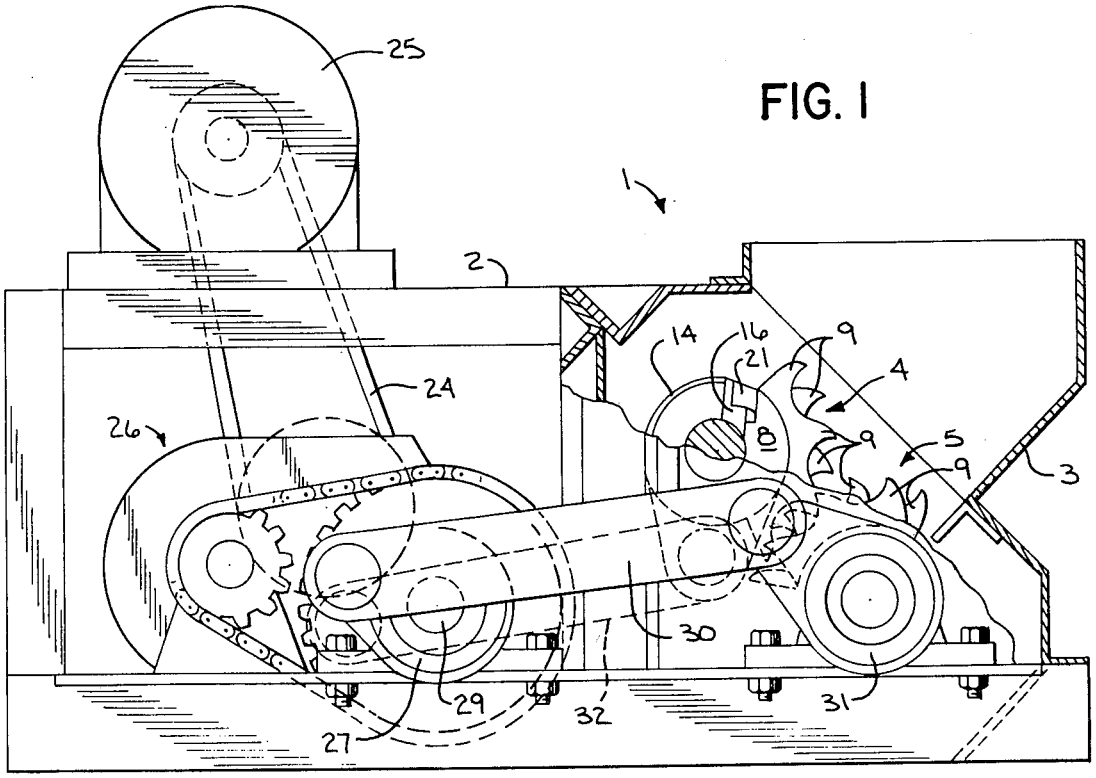
FIG. 1 is a schematic side view in elevation showing a shredder constructed in accordance with the principles of the present invention.
Figure 2:
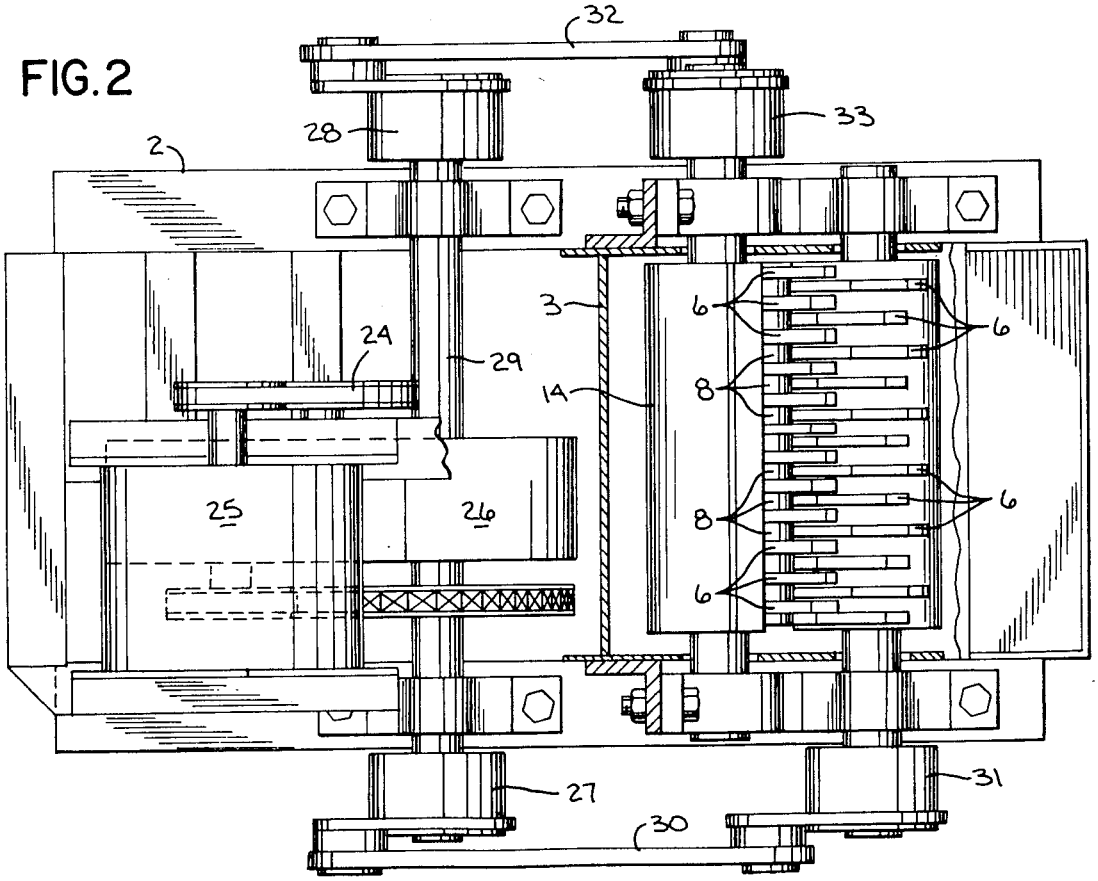
FIG. 2 is a top plan view with parts broken away of the shredder of FIG. 1.

Referring now to the drawings, FIGS. 1 and 2 illustrate a shredder, generally designated by the numeral 1, constituting a preferred embodiment of the present invention. Shredder 1 includes a housing 2 having feed hopper 3 positioned at one end thereof. The feed hopper 3 defines a shredding chamber having an inlet at its upper end and an outlet at its lower end. The hopper 3 allows for the feeding of various types of waste material to the shredding chamber. For example, shredder 1 may be used with paper products, rubber products such as tires, containers of glass, plastic, steel or aluminum, string, rope, cassette tapes, video tapes or other types of magnetic recording tape.

A pair of cooperating shredding rotors 4 and 5 are disposed on parallel horizontal axes extending across shredder 1 between the side walls of housing 2. As shown best in FIG. 1, the rotors 4 and 5 are mounted adjacent to one another with their axes of rotation in spaced relation in the shredding chamber.

Figure 3:
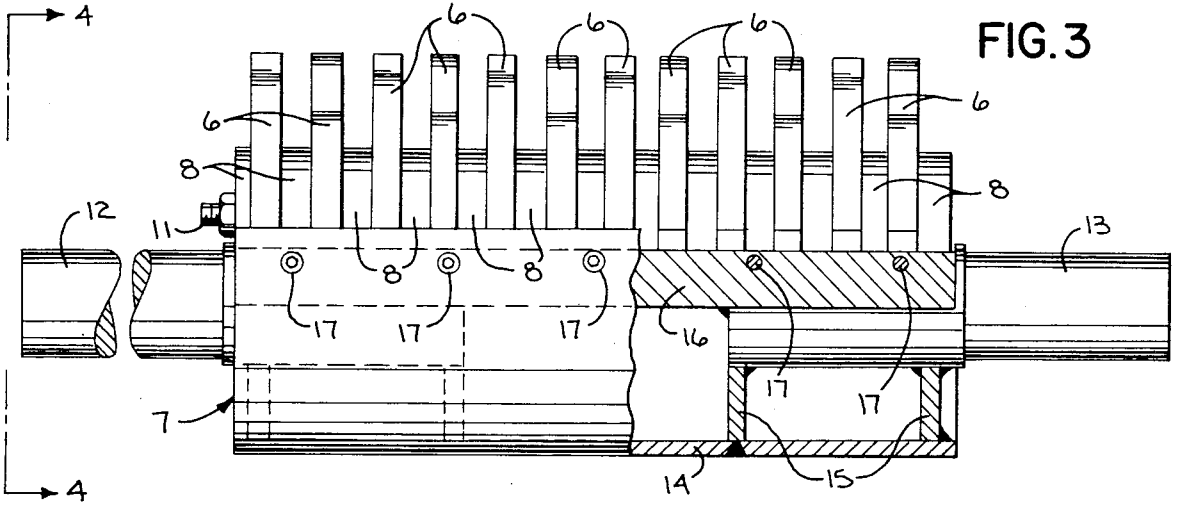
FIG. 3 is a view in elevation with parts broken away and in section of one of the oscillating rotors of the shredder.

Rotors 4 and 5 are identical in construction and thus only rotor 4 will be described in detail. Rotor 4 is thus shown in FIGS. 3 and 4 and includes a plurality of replaceable ripper blades 6 removably mounted as a unit on a supporting shaft assembly 7. The blades 6 are axially spaced along the axis of shaft assembly 7 and their spacial positions are maintained by means of spacers 8 positioned therebetween. As shown, each blade 6 is in the form of a thin flat disc and includes three circumferentially spaced shredding teeth 9. The teeth 9 are inclined with respect to the radius of each blade 6, and when assembled the teeth are inclined downwardly toward the outlet of the shredding chamber. Each blade 6 also includes a pair of openings 10 formed therethrough for receiving through bolts 11 which are utilized to mount the blades 6 in a stacked assembly which may be removed as a unit from the support shaft assembly 7 without also removing the shaft assembly 7, as will hereinafter be described.

The shaft assembly 7 includes a pair of stub shafts 12 and 13 which are journaled at their opposite ends in the side walls of housing 2 of shredder 1. Stub shafts 12 and 13 are interconnected by means of a tube 14 welded at both ends thereto. Each shaft 12 and 13 also includes a pair of supporting rings 15 extending between its outer surface and the inner surface of tube 14 for supporting tube 14. Stub shafts 12 and 13 are also interconnected by and support a mounting plate 16 welded thereto for mounting the removable blade assembly.

The blade assembly is removably mounted to the shaft assembly 7 by means of a dovetail joint arrangement and a plurality of screws 17. The dovetail joint includes a wedge-shaped projection or tenon 18 on the right hand side (FIG. 4) of mounting plate 16 that extends axially the length of plate 16 and fits into a corresponding indentation or mortise 19 in each blade 6. A notch 20 is formed in the left hand side of plate 16 opposite the tenon 18 and extends axially the entire length of plate 16. Notch 20 is adapted to receive a correspondingly shaped mounting bar 21. Mounting bar 21 includes wedge-shaped projection or tenon 22 that extends axially the entire length of mounting plate 16 and fits into a corresponding indentation or mortise 23 formed in each blade 6 to complete the dovetail joint arrangement. As shown, there are five mounting screws 17 which extend through mounting bar 21 into mounting plate 16. When tightened, screws 17 function to securely hold the replaceable blade assembly on shaft assembly 7. In order to accomplish this, the blades 6 are first assembled into a stacked arrangement by extending bolts 11 through the openings 10 in blades 6 and sandwiching the blade 6 together by means of tightening a nut 11*a* at the end of each bolt 11. This blade assembly is then positioned on the mounting plate 16 so that tenon 18 projects into indentation 19. Mounting bar 21 is then positioned so that its tenon 22 extends into indentation 23 and the screws 17 are tightened. In order to remove the blade assembly the reverse procedure is performed. Thus, blades 6 may be easily removed from the shredder 1 for repair or for replacement with wider or narrower teeth without removing the entire shaft assembly 7.

Figure 4:
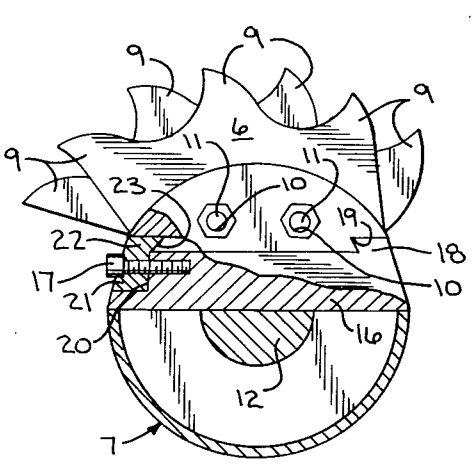
FIG. 4 is a view in cross section taken along the plane of the line 4—4 in FIG. 3.

The teeth 9 are mounted along each rotor 4 and 5 in a staggered relation to each other as shown best in FIG. 4. This staggered arrangement ensures that each tooth 9 will individually engage the waste material as it is fed into the shredding chamber. As shown best in FIG. 2, the teeth 9 of rotor 4 interleave with the teeth 9 of rotor 5 so that they rotate in overlapping or interfitting relation with each other. This interleaved arrangement ensures that waste material fed into the shredding chamber will be cut and pierced by the teeth 9. Thus, the teeth 9 of rotors 4 and 5, which are angled or pitched toward the outlet end of the shredding chamber, tend to draw waste material between the blades 6 wherein the material is shredded during passage therebetween. The inclination or pitch of teeth 9 also tends to force the shredded material toward the outlet of the shredding chamber so that the material may be compacted into a container (not shown) located below the rotors 4 and 5 for disposal.

Shredder 1 also includes drive means in driving engagement with rotors 4 and 5 for developing relative rotational oscillatory bi-directional motion between rotors 4 and 5 to shred waste material fed therebetween. The drive means is shown schematically in FIG. 1 and includes a crank arrangement for providing the rotary oscillatory motion for rotors 4 and 5. The crank arrangement is driven by means of a belt 24 which is traind around a drive shaft of a motor 25 through an appropriate speed reducer 26. The crank arrangement includes a pair of drive hubs 27 and 28 mounted on opposite ends of a crankshaft 29 which is journaled for rotation at its opposite ends in the side walls of housing 2. A crank arm 30 is pivotally connected to one end to drive hub 27 at a position which is radially spaced from its axis of rotation and is pivotally attached at its other end to the radially outer end of a lever arm 31. Lever arm 31 in turn is rotatably mounted to rotor 5 at its axis of rotation. Thus, as crankshaft 29 rotates rotor 5 will reciprocate in a rotary oscillatory motion. In order to oscillate rotor 4, a crank arm 32 is pivotally connected to one end to drive hub 28 at a position which is radially spaced from the axis of rotation of crankshaft 29, and is pivotally connected at its other end to the radially outer end of a lever arm 33. Lever arm 33 in turn is rotatably mounted to rotor 4 at its axis of rotation. Thus, as crankshaft 29 is rotated rotor 4 will reciprocate back and forth with a rotary oscillatory motion.

For purposes of this description, the bi-directional motion of the teeth 9 of rotors 4 and 5 will be described as either "advancing" when they are moving toward the outlet of the shredding chamber, or "retracting" when they are moving toward the inlet of the shredding chamber. In other words, the teeth 9 of rotor 5 in FIG. 1 are advancing when rotor 5 is rotated counterclockwise, and are retracting when rotated clockwise. It should also be noted that the pivot connections of crank arms 30 and 32 to crankshaft 29 are circumferentially spaced apart from one another as seen best in FIG. 1. This circumferential spacing causes the rotors 4 and 5 to be "out of phase". In other words, the rotors 4 and 5 do not reach their fully advanced or fully retracted positions at the same time. The fact that the rotors 4 and 5 are out of phase enables the teeth 9 to move at different angular velocities throughout their travel so that a tearing action is provided to clean the shredded material from teeth 9. If both rotors 4 and 5 were in phase and moved at the same angular velocity throughout their travel, there would be no tearing action taking place. Instead, there would only be a relative cutting and piercing action taking place by the teeth 9.

Figure 5:
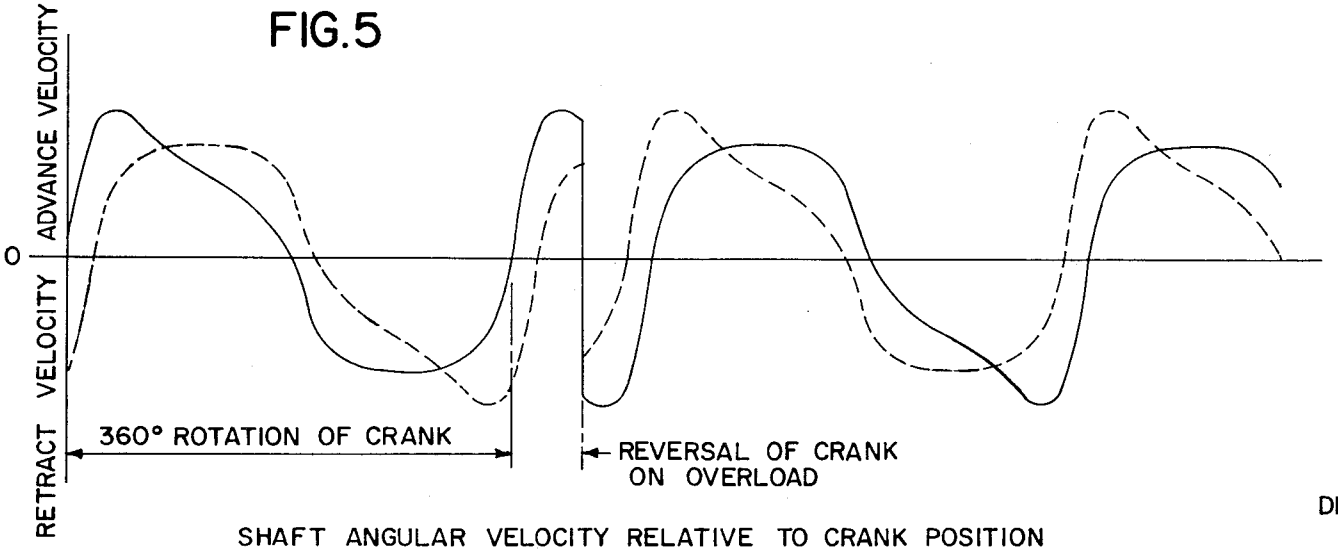
FIG. 5 is a graph illustrating the angular velocity of one of the rotors relative to the rotational position of a crank drive for the rotor.

In operation, crank arm 32 is shown in FIG. 1 in its dead center position with rotor 4 in its fully advanced position while crank arm 30 and rotor 5 are shown in intermediate positions. Assuming that crankshaft 29 is rotating counterclockwise, rotor 4 is thus shown in advance of rotor 5. The graph of FIG. 5 shows that rotor 4 is out of phase or in advance of rotor 5 by 20° of crank rotation, i.e. rotor 4 will reach its fully retracted or advanced position 20° of crankshaft 29 rotation before rotor 5. At the left side of the graph the angular velocity of rotor 4 is shown as a solid line, while the angular velocity of rotor 5 is shown as a dotted line. As crankshaft 29 moves in a counterclockwise direction from the position shown in FIG. 1, rotor 4 accelerates rapidly for about 45° of crankshaft 29 rotation, and then its angular velocity tapers off slowly until crank arm 32 once again reaches its dead center position wherein rotor 4 is fully retracted. At this point the angular velocity of rotor 4 is zero and crankshaft 29 is rotated 180° from the position shown in FIG. 1. While rotor 4 is moving from its fully advanced position to its fully retracted position, rotor 5 is 20° behind rotor 4 and will reach its fully retracted position later than rotor 4. Thus when rotor 4 reaches its fully retracted position rotor 5 is in an intermediate position still in the process of retracting.

As shown in the graph of FIG. 5, the teeth 9 will move at the same relative velocity only once every 180°. At all other times the teeth 9 of rotors 4 and 5 move at different angular velocities so that the waste material is pulled in faster by one shaft than the other and this causes a tumbling motion and agitation of the material as it is forced between rotors 4 and 5. FIG. 5 further shows that the acceleration of the blades of each rotor 4 and 5 is continuously varying over 360° rotation of crankshaft 29. The angle by which the rotors 4 and 5 are out of phase may be varied to achieve different relative velocity values depending upon the type of waste material being shredded.

At the center of the graph of FIG. 5 there is illustrated an overload situation to show what happens when too much load develops on rotors 4 and 5, i.e. a jamming situation. Such an overload might be sensed in any conventional manner such as by an amperage reading of the drive motor 25. If an overload occurs, motor 25 would stop and would then begin rotating in the reverse direction. This would retract the material fed to the shredding chamber and the angular velocities of the teeth 9 of rotors 4 and 5 would change as shown on the graph.

In addition to the phase relationship and angular velocities, the rotary oscillatory motion of rotors 4 and 5 provide two other variables which may be altered depending upon the material being shredded. One variable is the amplitude or arc through which each rotor 4 and 5 is rotated, and the other variable is the period or amount of time it takes for each rotor 4 or 5 to complete an oscillatory cycle. The graph of FIG. 5 illustrates a situation in which rotors 4 and 5 each oscillate through 130° of total movement from dead center to dead center. Larger amplitudes are possible but as the amplitude increases the effective torque on each rotor 4 or 5 would be decreased. Smaller amplitudes are also possible in which case the velocity curves shown in FIG. 5 would simply flatten while retaining basically the same relative shape. It is also obvious to those skilled in the art that one rotor might oscillate through an amplitude of 100° while the other rotor might oscillate through an amplitude of 130° to achieve greater relative velocity between the teeth 9. This situation could be achieved by altering the length of lever arm 31 or 33 of rotor 4 or 5, respectively, or by a lever arm which is adjustable in length to change the degree of rotation of rotor 4 or 5 per revolution of crankshaft 29. Further, two crankshafts may be utilized instead of a single crankshaft. In such a case each crankshaft might be rotated at different velocities. For example, if one crankshaft was operated at twice the speed of the other, that particular rotor would go through two cycles for every one cycle of the slower crankshaft.

Figure 6:
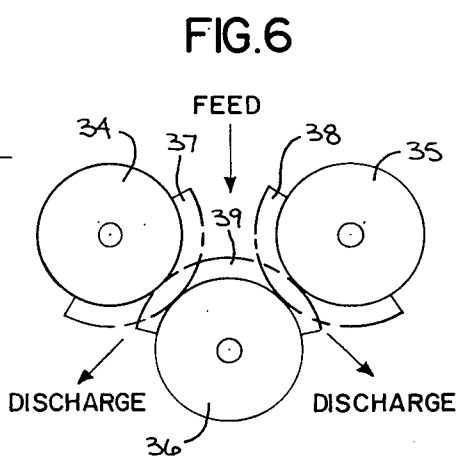
FIG. 6 is a schematic view showing an alternate embodiment of the shredder of the present invention.

FIG. 6 schematically illustrates a second embodiment of the shredder of the present invention. In this embodiment there are three rotors 34, 35 and 36 instead of the two rotors 4 and 5 previously described. Rotor 36 is positioned an equal distance from rotors 34 and 35 at the outlet end of the shredding chamber with rotors 34 and 35 spaced farther apart than rotors 4 and 5 of the first embodiment so that their teeth 37 and 38, respectively, are not overlapping but instead are overlapping only with teeth 39 of rotor 36. In such an arrangement the teeth 39 of rotor 36 would alternately work against rotor 34 or 35 and shred material in two directions of discharge. Rotors 34 and 35 are 180° out of phase with each other and would act as feeders to rotor 36. In addition, rotors 34 and 35 would perform some precrushing operations as they feed the material to rotor 36.

A shredder has been shown and described which includes cooperating shredding rotors which are rotatably oscillated to shred waste material fed therebetween. Various modifications and/or substitutions of the components specifically described herein may be made without departing from the scope of the present invention. For example, the drive means for developing the relative rotational oscillatory motion between rotors 4 and 5 or between rotors 34, 35 and 36 need not necessarily be a crank arrangement. In addition, the amplitude, period, phase relationship and angular velocity of the rotors 4 and 5, or 34–36 may be varied to provide the most beneficial operation depending upon the type of waste material being shredded.

Various modes of carrying out the invention are contemplated as being within the scope of the following claims which particularly point out and distinctly claim the subject matter which is regarded as the invention.

I claim:

1. A rotary shredder, comprising:

first and second cooperating shredding rotors rotatably mounted adjacent to one another and each rotating about an axis, each rotor includes a plurality of axially spaced ripper blades positioned so that the blades of one rotor are located adjacent to the blades of the other rotor; and drive means in driving engagement with said rotors to bi-directionally rotate each rotor about its axis during a normal shredding cycle while shredding material by the relative rotational oscillatory motion between said rotors and during at least a portion of said cycle said first and second rotors rotate in the same direction so that said first rotor advances while simultaneously said second rotor retracts to shred material fed therebetween.

2. The shredder of claim 1, wherein said drive means includes means to oscillate said first and second rotors through a different amplitude with respect to each other to provide a shredding operation.

3. The shredder of claim 1, wherein said drive means includes means to oscillate said first and second rotors with a different oscillatory period with respect to each other to provide a shredding operation.

4. A rotory shredder, comprising:

first and second cooperating shredding rotors rotatably mounted adjacent to one another and each rotating about an axis, each rotor includes a plurality of axially spaced ripper blades positioned so that the blades of one rotor are axially spaced from the blades of the other rotor;

a third cooperating shredding rotor rotatably mounted adjacent to said first and second rotors, said third rotor includes a plurality of axially spaced ripper blades positioned to interleave with the blades of said first and second rotors; and drive means in driving engagement with said rotors to bi-directionally rotate said first, second and third rotors about their respective axis during a normal shredding cycle while shredding material by the relative rotational oscillatory motion between said rotors and during at least a portion of said cycle two of said rotors rotate in the same direction so that one of said two rotors advances while simultaneously the other of said two rotors retracts to shred material feed therebetween.

5. The shredder of claim 4, wherein said third rotor is positioned between and below said first and second rotors.

6. The shredder of claim 4, wherein said first and second rotors are oscillated 180° out of phase with respect to each other.

7. A rotary shredder, comprising:

first and second cooperating shredding rotors rotatably mounted adjacent to one another and each rotating about an axis, each rotor includes a plurality of axially spaced ripper blades positioned so that the blades of one rotor are located adjacent to the blades of the other rotor; and drive means in driving engagement with said rotors for bi-directionally rotating said rotors about their respective axis during a normal shredding cycle while shredding material so that the relative angular velocity of said blades continuously vary with respect to one another and during at least a portion of said cycle said first and second rotors rotate in the same direction so that said first rotor advances while simultaneously said second rotor retracts to shred waste material fed therebetween.

8. The shredder of claim 7, wherein said drive means develops oscillatory bi-directional motion for each rotor.

9. A rotary shredder, comprising:

a housing which defines a shredding chamber having an inlet and an outlet;

first and second cooperating shredding rotors rotatably mounted adjacent to one another in said chamber and each rotating about an axis, each rotor includes a plurality of axially spaced ripper blades positioned so that the blades of one rotor interleave with the blades of the other rotor, each blade having a plurality of circumferentially spaced teeth pitched toward the outlet of said chamber; and drive means in driving engagement with said rotors to bi-directionally rotate each rotor about its axis during a normal shredding cycle while shredding material by the relative rotational oscillatory motion between said rotors and during at least a portion of said cycle said first and second rotors rotate in the same direction so that said first rotor advances while simultaneously said second rotor retracts to shred waste material fed therebetween whereby said teeth force the shredded material toward the outlet to compact the material into a container positioned at said outlet.

10. A rotary shredder, comprising:

first and second cooperating shredding rotors rotatably mounted adjacent to one another and each rotating about an axis, each rotor includes a plurality of axially spaced ripper blades positioned so that the blades of one rotor are located adjacent to the blades of the other rotor; and drive means in driving engagement with said rotors for bi-directionally rotating one of said rotors about its axis during a normal shredding cycle while shredding material at a first predetermined oscillatory cyclic rate and for bi-directionally rotating the other of said rotors about its axis during a normal shredding cycle while shredding material at a second predetermined oscillatory cyclic rate which is different from said first cyclic rate and during at least a portion of said cycle said first and second rotors rotate in the same direction so that said first rotor advances while simultaneously said second rotor retracts.

11. A rotary shredder, comprising means for providing a fixed support, means rotatively mounted to said fixed support for providing a mounting surface, a sub-assembly removably connected to said mounting surface and including a series of radially extending blades each having an opening to retain a removable rod to form a stack of operatively inter-connected blades capable of being independently movable as an independent unit apart from said rotatable mounting surface, and means for removably connecting said sub-assembly to said mounting surface for rotation therewith including a mounting bar removably attached to said mounting surface means solely by releasable elements positioned along a radially spaced surface to permit easy external access thereto to provide a shredding operation and for removing said sub-assembly from said mounting surface for repair or replacement of said blades apart from said mounting surface.

12. A rotary shredder, comprising a fixed support, and a shredding rotor assembly including a shaft assembly providing a mounting plate including an axially extending wedged shaped projection spaced from an axially extending notch and operatively connected to oppositely spaced stub shafts operatively connected to said fixed support for rotation and a removable blade sub-assembly including a series of radially extending blades separated by intervening spacers with said blades and spacers each having an opening to retain a removable bolt secured by a nut to form a stack of interconnected blades and spacers forming a movable sub-assembly, said series of stacked blades providing first and second axially extending indentations with said first indentation removably latched to said wedged shaped projection provided by said mounting plate and a mounting bar removably attached to said mounting plate notch solely by threaded bolts connected along a radially spaced surface of said shaft assembly to permit easy external access thereto and including a wedged shaped tenon removably engaging said second indentation of said stacked blades to removably secure said blade sub-assembly to said shaft assembly for rotation therewith to provide a shredding operation while permitting removal of said sub-assembly by the removal of said mounting bar.

* * * * *